US010118070B2

(12) United States Patent
Lin

(10) Patent No.: US 10,118,070 B2
(45) Date of Patent: Nov. 6, 2018

(54) SQUAT RACK

(71) Applicant: ASIA REGENT CORPORATION, Taichung (TW)

(72) Inventor: Yi-Hung Lin, Taichung (TW)

(73) Assignee: ASIA REGENT CORPORATION, Taichung (TW)

( * ) Notice: Subject to any disclaimer, the term of this patent is extended or adjusted under 35 U.S.C. 154(b) by 316 days.

(21) Appl. No.: 15/017,588

(22) Filed: Feb. 6, 2016

(65) Prior Publication Data

US 2017/0225029 A1 Aug. 10, 2017

(51) Int. Cl.
*A63B 21/00* (2006.01)
*A63B 23/04* (2006.01)

(52) U.S. Cl.
CPC ..... *A63B 23/0405* (2013.01); *A63B 21/159* (2013.01); *A63B 21/4035* (2015.10); *A63B 21/4047* (2015.10); *A63B 2023/0411* (2013.01)

(58) Field of Classification Search
CPC ..... A63B 23/0405; A63B 21/4047; A63B 21/4035; A63B 21/159; A63B 2023/0411; A63B 23/02–23/0227; A63B 23/0233; A63B 2208/0223
See application file for complete search history.

(56) References Cited

U.S. PATENT DOCUMENTS 5,580,340 A * 12/1996 Yu ..... A63B 21/055 482/72
5,586,959 A * 12/1996 Adkins ..... A63B 21/068 482/72
6,022,298 A * 2/2000 Svedarsky ..... A63B 21/0615 482/130
6,135,930 A * 10/2000 Kuo ..... A63B 22/001 482/57
6,234,942 B1 * 5/2001 Yang ..... A63B 21/023 482/132
6,752,748 B1 * 6/2004 Scotti ..... A63B 21/0615 482/140
7,108,642 B1 * 9/2006 Stearns ..... A63B 23/0211 482/121
7,229,389 B2 * 6/2007 Hong ..... A63B 21/0552 482/142
7,998,039 B1 * 8/2011 Wallach ..... A63B 21/023 482/121
9,662,536 B1 * 5/2017 Lin ..... A63B 23/0405
2004/0209752 A1 * 10/2004 Thonn, Jr. ..... A63B 21/00072 482/140
2014/0066275 A1 * 3/2014 Miller, Jr. ..... A63B 21/068 482/142
2017/0225029 A1 * 8/2017 Lin ..... A63B 23/0405

* cited by examiner

*Primary Examiner* — Gregory Winter

(57) ABSTRACT

A squat rack includes a frame, a tread unit, a lifting unit, a pulling unit and a connector. The tread unit includes two treads connected to and located on two sides of the frame for supporting a user's feet so that the frame is firmly kept on the ground by the user. The lifting unit is pivotally connected to the frame and located behind the user in operation. The pulling unit includes a middle portion pivotally connected to a front end of the frame. The connector pivotally connects a lower end of the pulling unit to the lifting unit so that the user can pull the pulling unit to cause the lifting unit to support the user's hips via the connector.

14 Claims, 11 Drawing Sheets

SQUAT RACK

BACKGROUND OF INVENTION

1. Field of Invention

The present invention relates to an exercise machine and, more particularly, to a squat rack.

2. Related Prior Art

To squat, a person has to use his or her upper legs, abdomen and lower back. Hence, a person can squat to exercise muscles in his or her torso, waist, abdomen, hips and upper legs. However, a person can exert too much stress in his or her knees or upper legs and hence excessively wear the knees or pull the muscles in the upper legs.

Taiwanese Patent Publication No. 313866 discloses a conventional squat rack for helping a user squat. The conventional squat rack includes a lower tube 1 connected to a upper tube 2, a seat tube 10 pivotally connected to the upper tube 2, a leg tube 20 pivotally connected to the upper tube 2, a handle 30 pivotally connected to the upper tube 2, a connector 4 for connecting the seat tube 10 to the leg tube 20, and a connector 40 for connecting the seat tube 10 to the handle 30. Thus, the leg tube 20 is pivoted together with the handle 30. Hence, the user's hands, torso and legs move together with the conventional squat rack. Hence, the user's muscles in the waist and upper legs are only subject to light loads. That is, the user does not exercise the waist and upper legs sufficiently. The conventional squat rack is not effective in helping the user to exercise the waist and upper legs.

The present invention is therefore intended to obviate or at least alleviate the problems encountered in prior art.

SUMMARY OF INVENTION

It is an objective of the present invention to provide a simple and inexpensive squat rack squat rack for helping a user squat.

It is another objective of the present invention to provide a squat rack with which a user exercises without exerting excessive stress in his or her muscles.

To achieve the foregoing objectives, the squat rack includes a frame, a tread unit, a lifting unit, a pulling unit and a connector. The tread unit includes two treads connected to and located on two sides of the frame for supporting a user's feet so that the frame is firmly kept on the ground by the user. The lifting unit is pivotally connected to the frame and located behind the user in operation. The pulling unit includes a middle portion pivotally connected to a front end of the frame. The connector pivotally connects a lower end of the pulling unit to the lifting unit so that the user can pull the pulling unit to cause the lifting unit to support the user's hips via the connector.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 1:
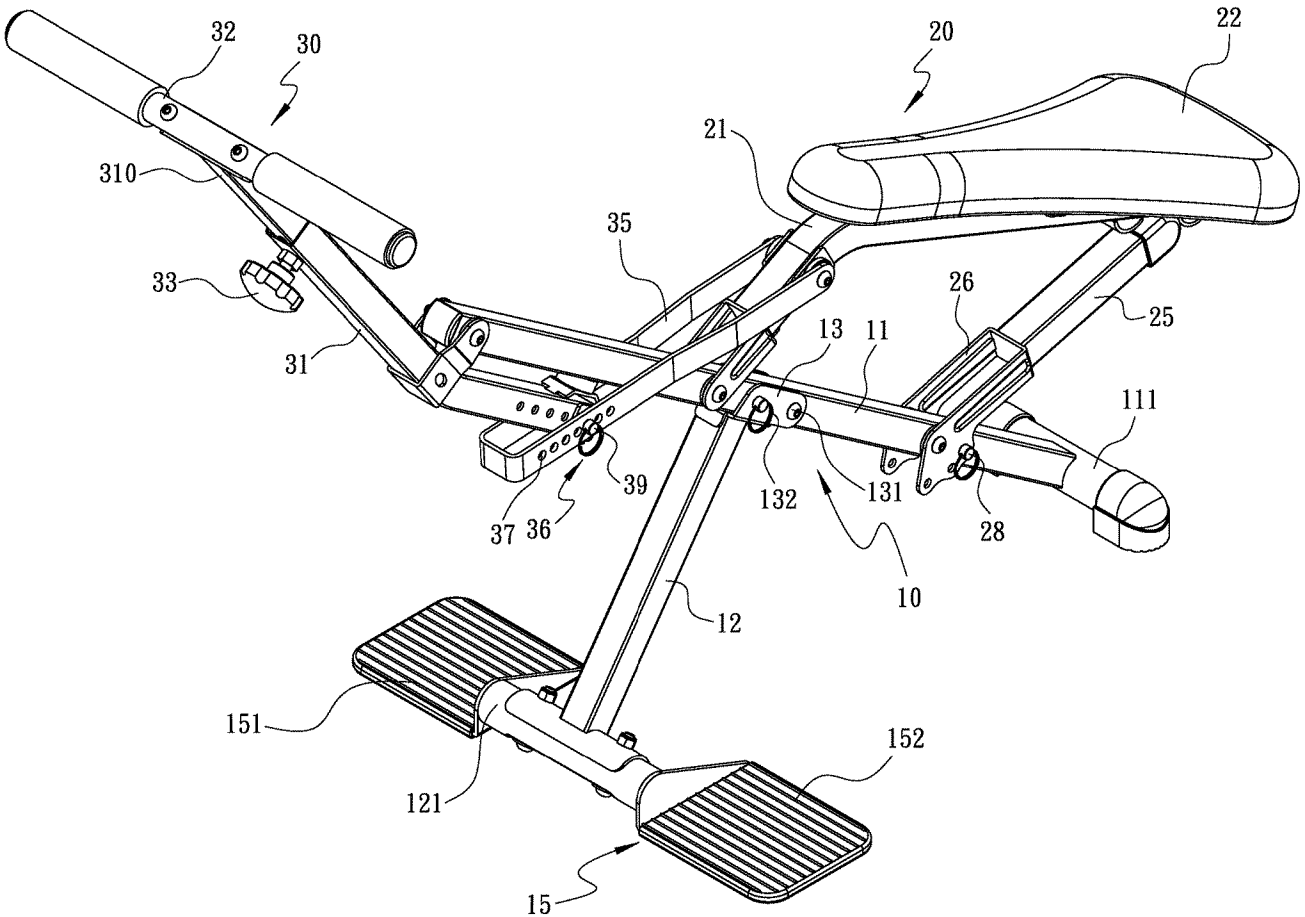
FIG. 1 is a perspective view of a squat rack for helping a user squat according to the first embodiment of the present invention.
Figure 2:
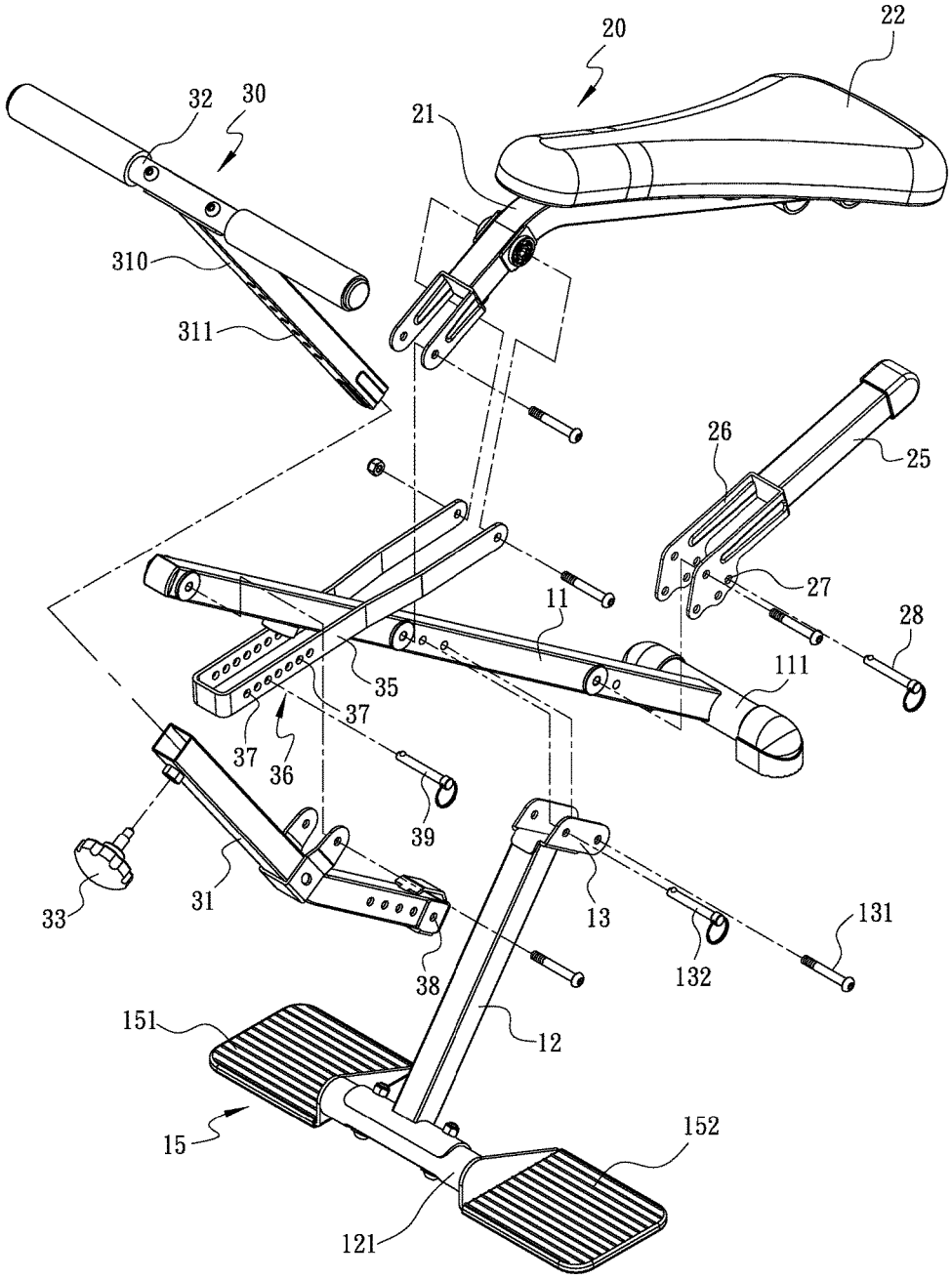
FIG. 2 is an exploded view of the squat rack shown in FIG. 1.
Figure 3:
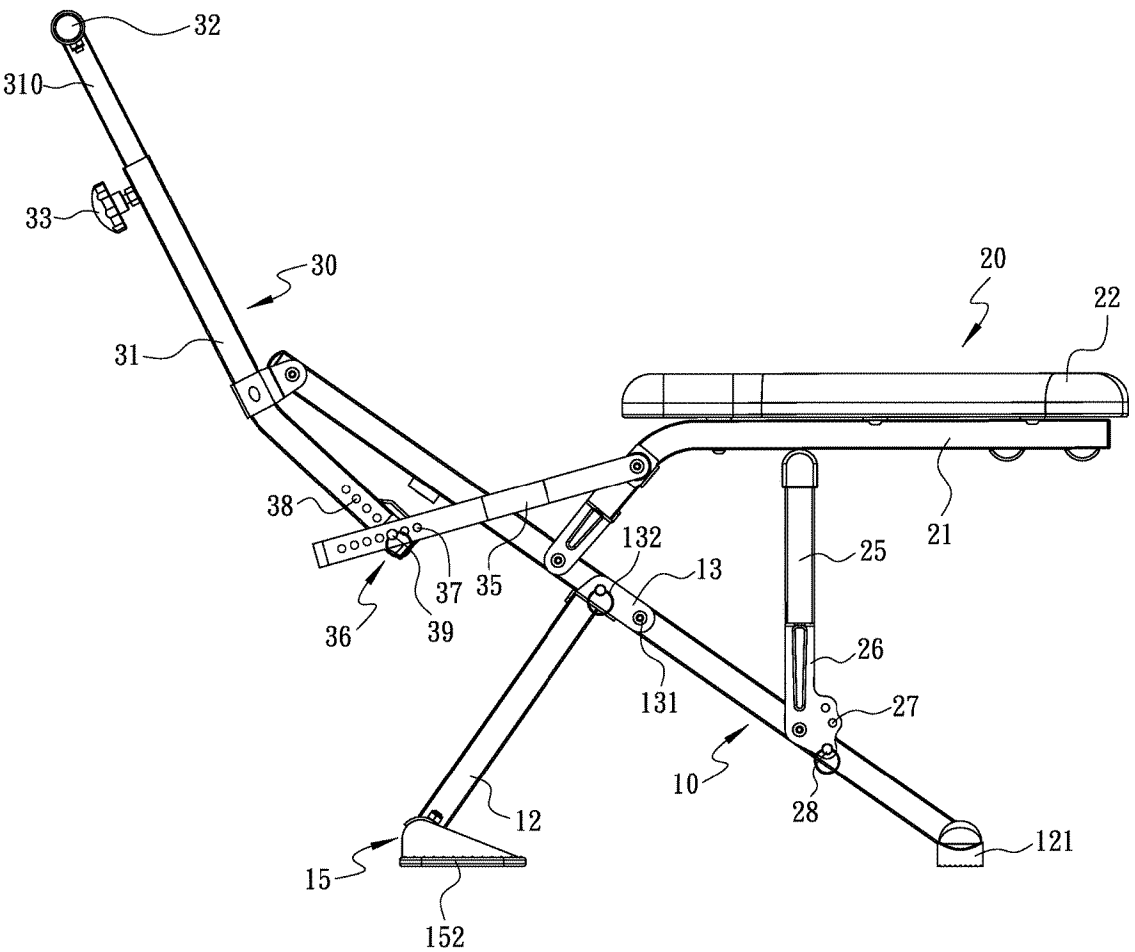
FIG. 3 is a right side view of the squat rack shown in FIG. 1.
Figure 8:
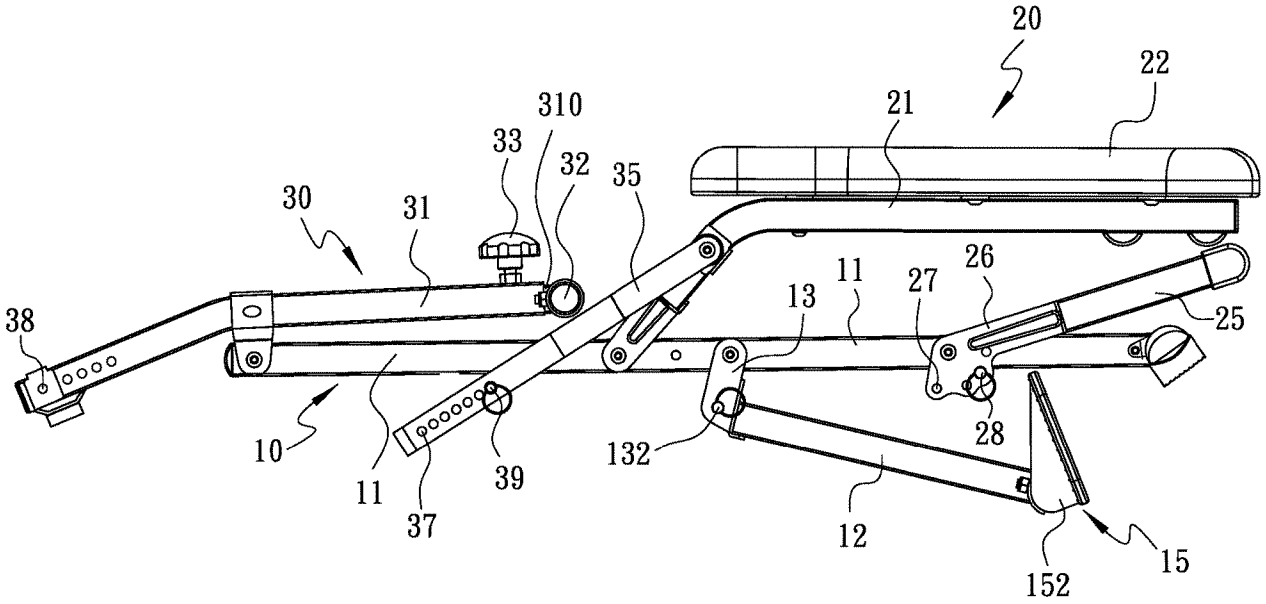
FIG. 8 is a right side view of the squat rack in a collapsed position other than the extended position shown in FIG. 3.

Referring to FIGS. 1 through 3, a squat rack includes a frame 10, a lifting unit 20 and a pulling unit 30 according to a first embodiment of the present invention. The frame 10 includes an upper tube 11 and a lower tube 12. The upper tube 11 includes a crossbar 111 at a lower end. A middle portion of the upper tube 11 is pivotally connected an upper end of the lower tube 12 by a pivotal joint 13. The lower tube 12 includes a crossbar 121 at a lower end. The pivotal joint 13 includes two lugs (not numbered) connected to the upper end of the lower tube 12 by welding for example, an axle 131 inserted in the upper tube 11, and a pin 132 selectively inserted in the upper tube 11. When the lower tube 12 is opened relative to the upper tube 11, the pin 132 is inserted in the lugs of the pivotal joint 13 and the upper tube 11, to keep the lower tube 12 in position relative to the upper tube 11. Referring to FIG. 8, the pin 132 is selectively pulled from the upper tube 11 to allow pivoting of the lower tube 12 relative to the upper tube 11.

Figure 7:
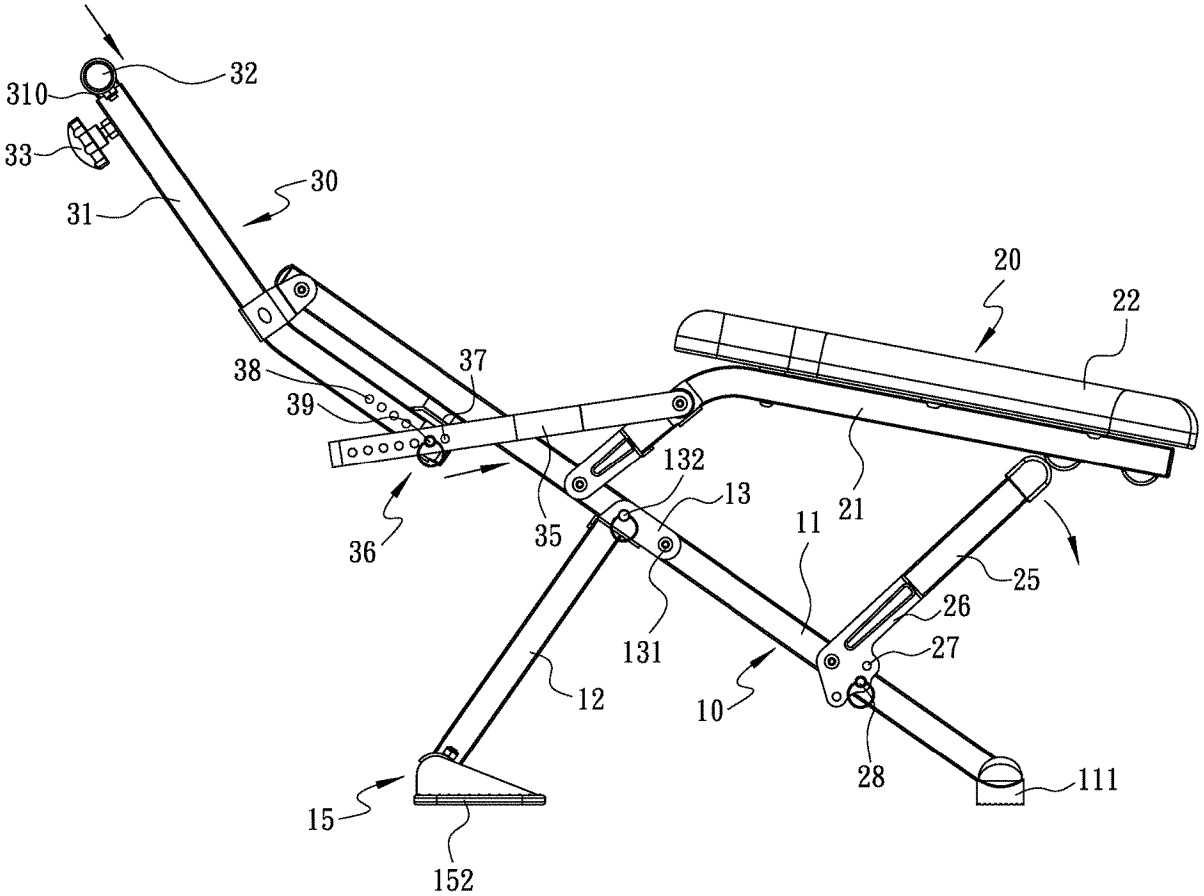
FIG. 7 is a right side view of the squat rack shown in FIG. 1 in a adjustment operation.

The lifting unit 20 is pivotally connected to the upper tube 11 of the frame 10. The lifting unit 20 includes a seat tube 21, a seat 22 and a strut 25. A front, lower end of the seat tube 21 is pivotally connected to a middle portion of the upper tube 11. The seat 22 is supported on the seat tube 21. The seat 22 is elongated element on which a user can move to and fro. The position of the seat 22 on the seat tube 21 is preferably adjustable. A rear, upper end of the strut 25 is pivotally connected to a rear, upper end of the seat tube 21. A front, lower end of the strut 25 is pivotally connected to the upper tube 11 the frame 10 via a pivotal joint 26. The pivotal joint 26 includes a plurality of apertures 27 arranged about a pivotal center. Referring to FIG. 7, a pin 28 is inserted in a selected one of the apertures 27 to locate the strut 25 at a selected one of several angles relative to the upper tube 11, thus adjusting the elevation of the seat tube 21 on the strut 25.

The pulling unit 30 is pivotally connected the upper tube 11 of the frame 10. The pulling unit 30 includes a lever 31, an extensive element 310, a fastener 33 and a handle 32. A middle portion of the lever 31 is pivotally connected to the front, upper end of the upper tube 11. The extensive element 310 is telescopically connected to the lever 31. The handle 32 is connected to a front, upper end of the extensive element 310. The extensive element 310 includes apertures 311. The fastener 33 is inserted in a selected one of the apertures 311 to adjust the entire length of the combination of the extensive element 310 with the lever 31, i.e., the stroke of the pivotal movement of the handle 32 on the lever 31.

The pulling unit 30 is operatively connected to the lifting unit 20. A rear, lower end of the lever 31 is connected to a middle portion of the seat tube 21 via a connector 35. Thus, the user exerts a lifting force on the seat tube 21 when he or she exerts a pulling force on the lever 31. In a process of standing up, the pulling force facilitates backward and upward movement of the handle 32 to help his or her legs to sand up. In a process of squatting, the pulling force slows rearward and downward movement of the seat tube 21 to help his or her legs squat. There is a adjustment unit 36 between the lever 31 and the connector 35.

The adjustment unit 36 includes apertures 38 in the lever 31 and apertures 37 in the connector 35. Referring to FIG. 7, a pin 39 is inserted in a selected one of the apertures 38 and a selected one of the apertures 37 to adjust the tilt of the lever 31 to adjust a stroke of movement of the lifting unit 20 relative to the pulling unit 30.

The apertures 38 are used to adjust the mechanical effect of the leverage of the lever 31 and hence the pulling force required to help the user stand up and squat. For example, referring to FIG. 8, the pin 39 can be inserted in one of the apertures closer to the handle 32 to use his or her hands to provide more support to his or her legs.

The pin 39 can be pulled out of the apertures 37 and 38 to allow the lever 31 to collapse relative to the upper tube 11.

There can be a plurality of apertures 37 and only one aperture 38 in an alternative embodiment. There can be only one aperture 37 and a plurality of apertures 38 in an alternative embodiment.

The tread unit 15 is securely connected to the frame 10. The user can set his or her feet on the tread unit 15 to use his or her own weight to keep the frame 10 still on the ground while using the squat rack. The tread unit 15 includes two treads 151 and 152 connected to two ends of the crossbar 121, which is connected to the front, lower end of the lower tube 12. In a horizontal sense, the tread unit 15 is located between the point of connection of the seat tube 21 with the upper tube 11 and the point of connection of the lever 31 with the upper tube 11, thus enabling the user to completely stretch his or her legs while standing up.

Figure 4:
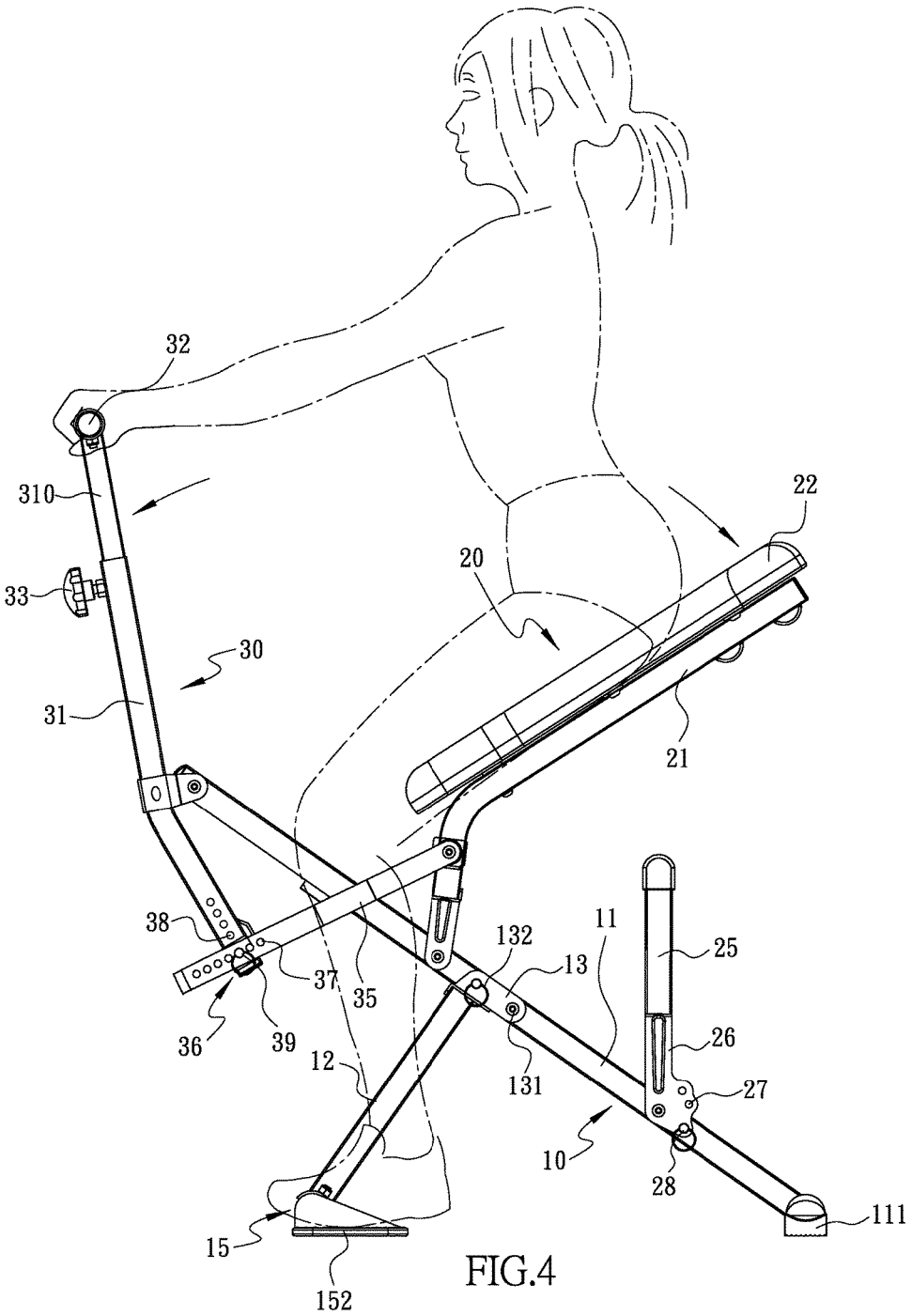
FIG. 4 is a right side view of a user using the squat rack shown in FIG. 3.

Referring to FIG. 4, in use, the user sets his or her feet on the treads 151 and 152 of the tread unit 1, and holds the handle 32 of the pulling unit 30 with his or her hands. Then, the user pulls the lever 31 of the pulling unit 30 towards his or her chest and lifts the seat tube 21 of the lifting unit 20 towards his or her hips via the connector 35, thus helping the user stand up.

Figure 5:
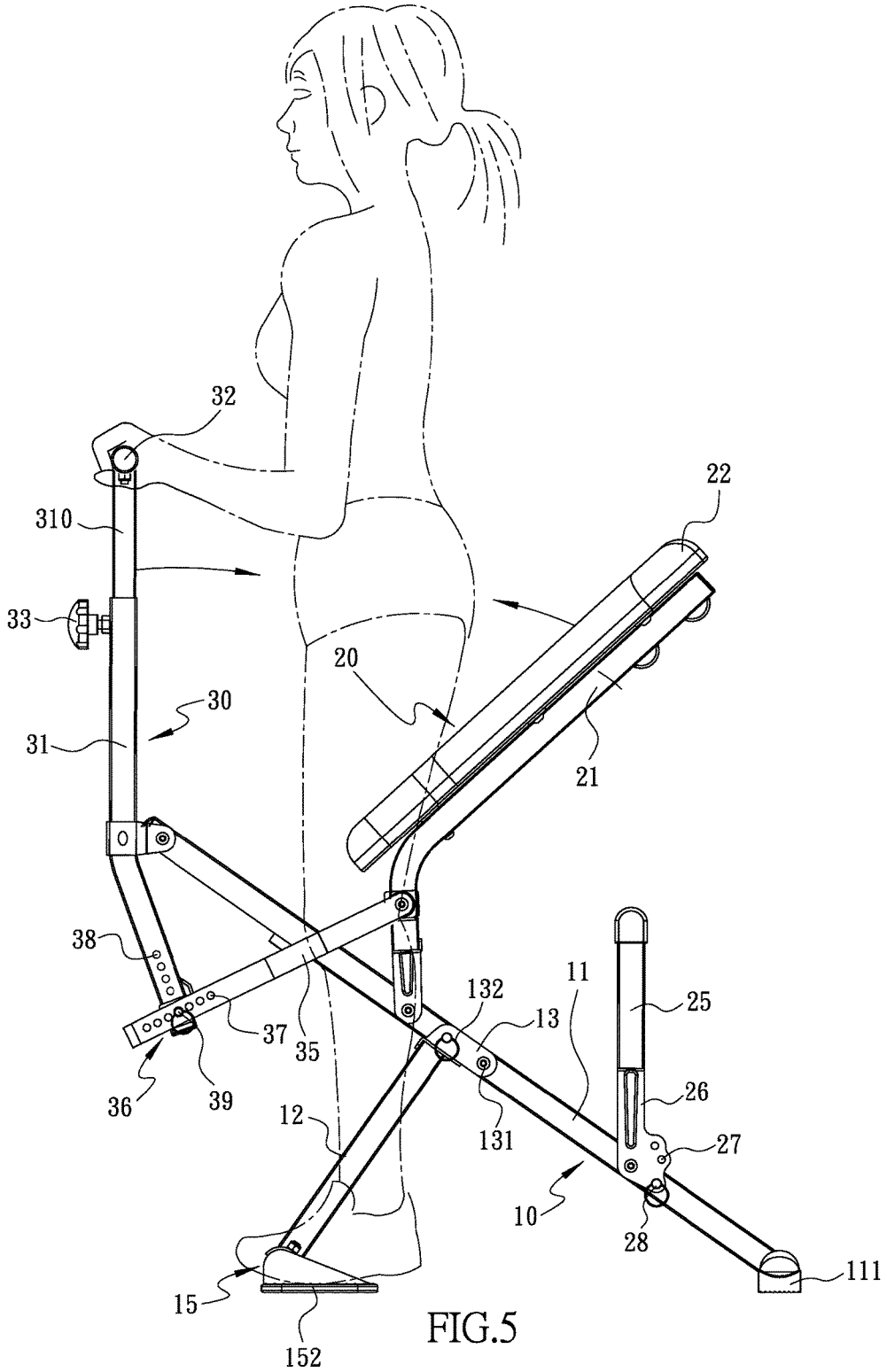
FIG. 5 is a right side view of the user and the squat rack in another position than shown in FIG. 4.

Then, referring to FIG. 5, the user bends his or her knees and lowers the hips. That is, the user is in a half-stand-half-squat position. The lifting unit 20 supports the hips since the user holds the handle 32 of the pulling unit 30, and the lever 31 is connected to the seat tube 21 via the connector 35. The user can further bend his or her knees and lowers the hips without much difficult because the hips and hence the legs are supported by the seat 22 that is lifted by the hands via the connector 35.

The steps shown in FIGS. 4 and 5 can be repeated to enable the user to squat and stand repeatedly. Hence, the user can be used to exercise and train his or her muscles.

Figure 6:
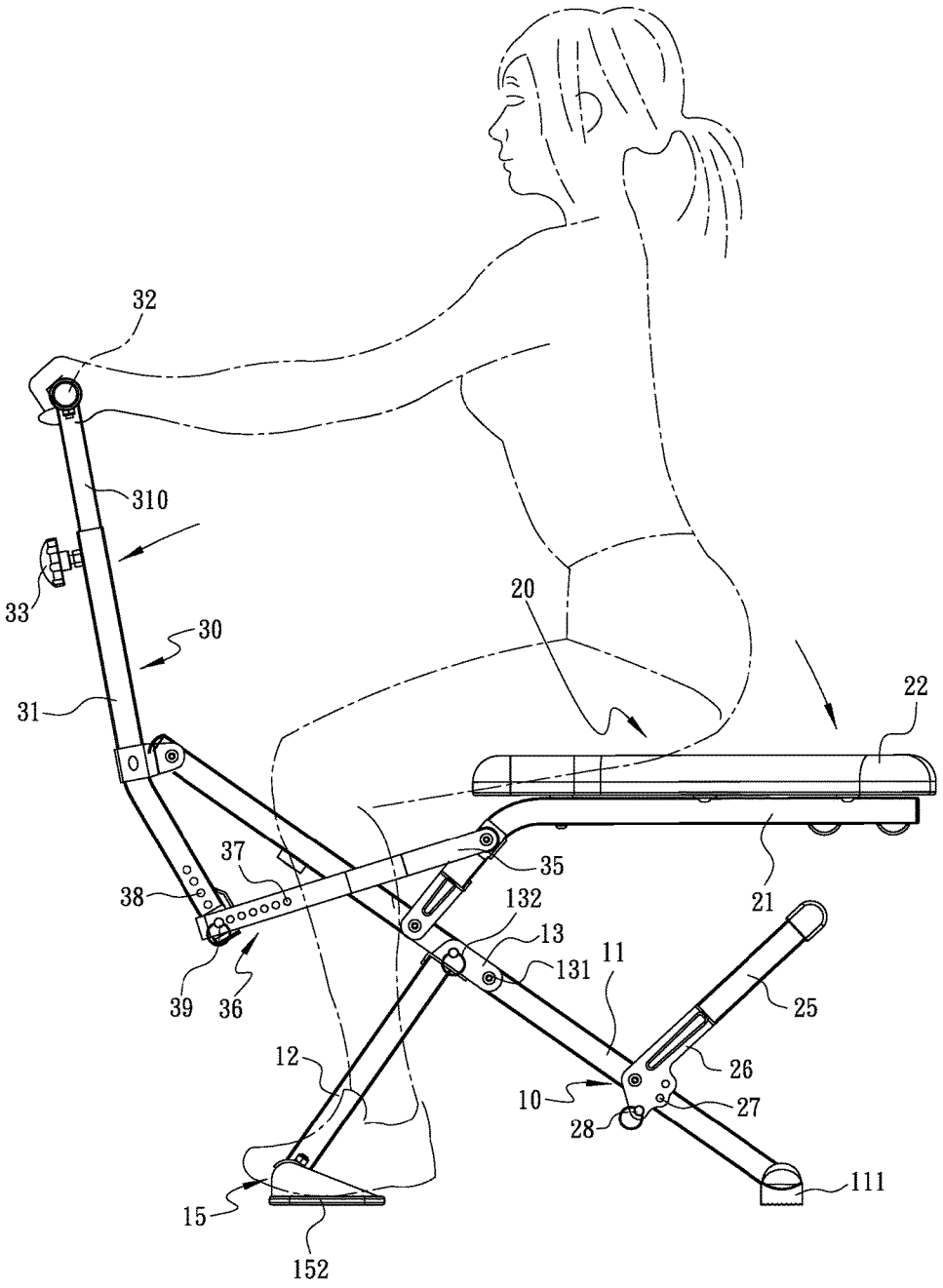
FIG. 6 is a right side view of the user and the squat rack in another position than shown in FIG. 5.

Referring to FIG. 6, the angle of the strut 25 of the lifting unit 20 is changed to change the elevation of the seat tube 21 to increase the extent to which the user squat. The adjustment unit 36 of the lever 31 of the pulling unit 30 is inserted in a selected one of the aperture 37 of the connector 35 to locate the lever 31 at a desired angle corresponding to the length of the user's arms. Thus, the user can squat lower.

Figure 9:
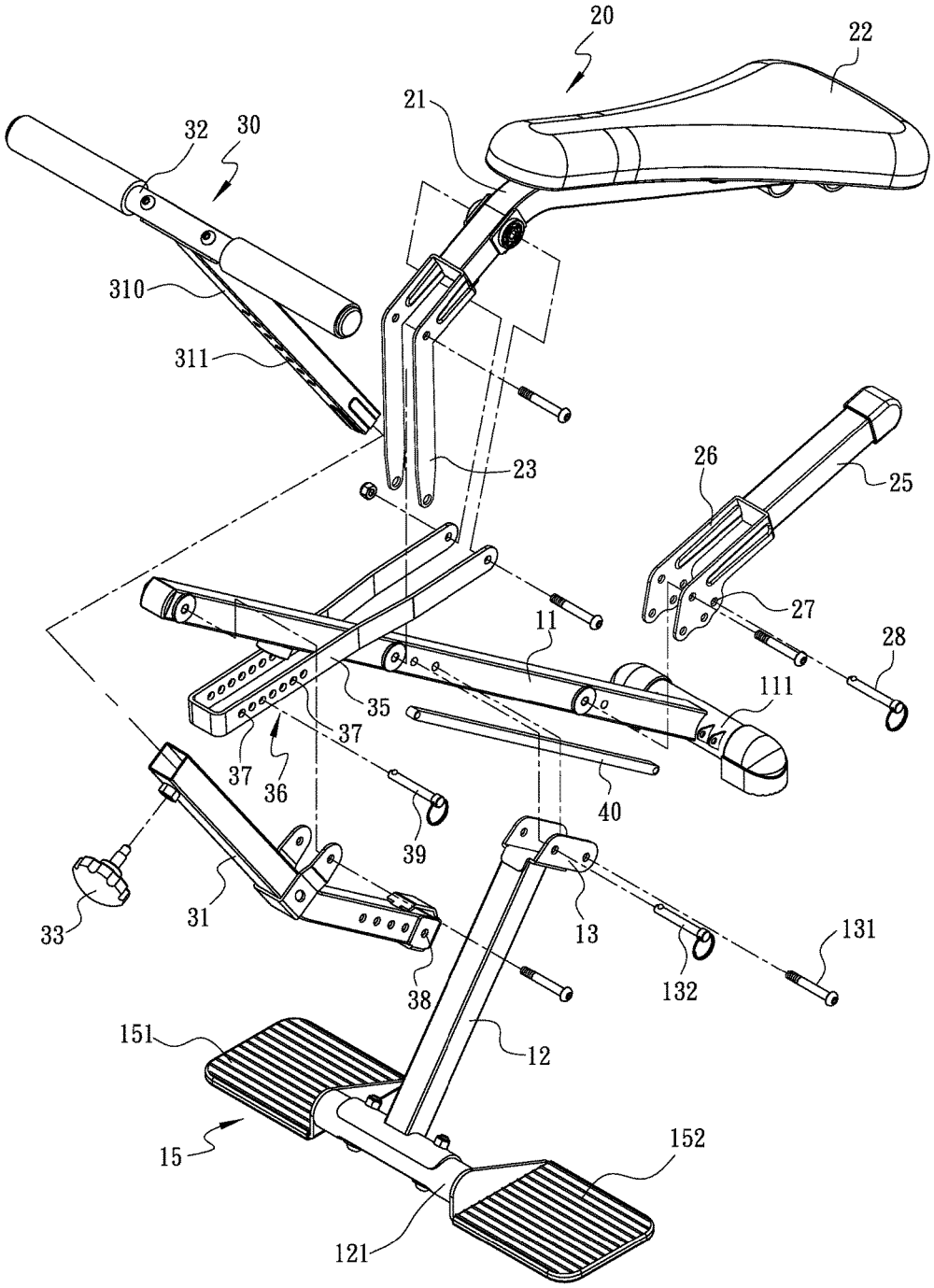
FIG. 9 is an exploded view of a squat rack for helping a user squat according to the second embodiment of the present invention.
Figure 10:
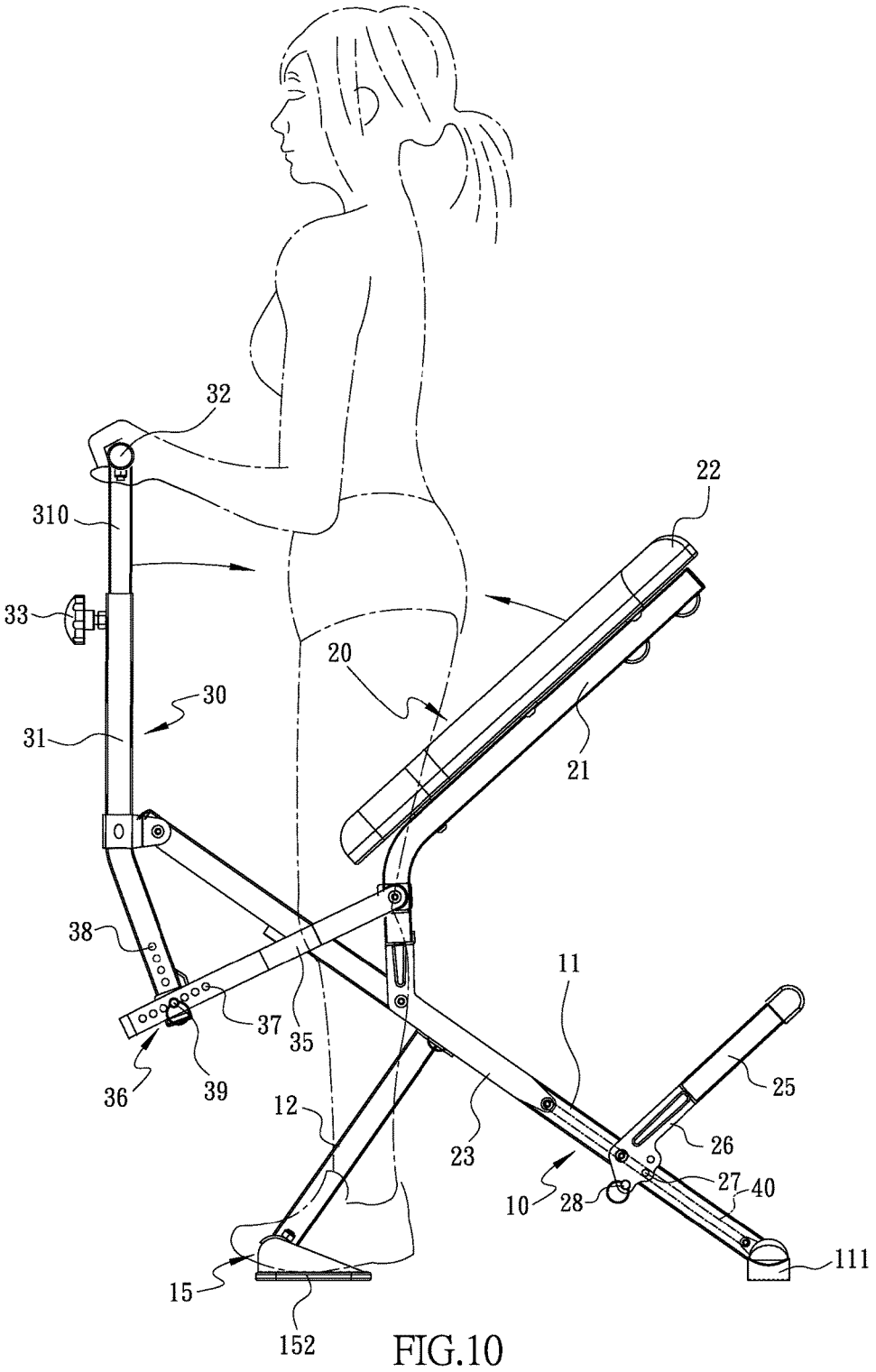
FIG. 10 is a right side view of a user using the squat rack shown in FIG. 9.
Figure 11:
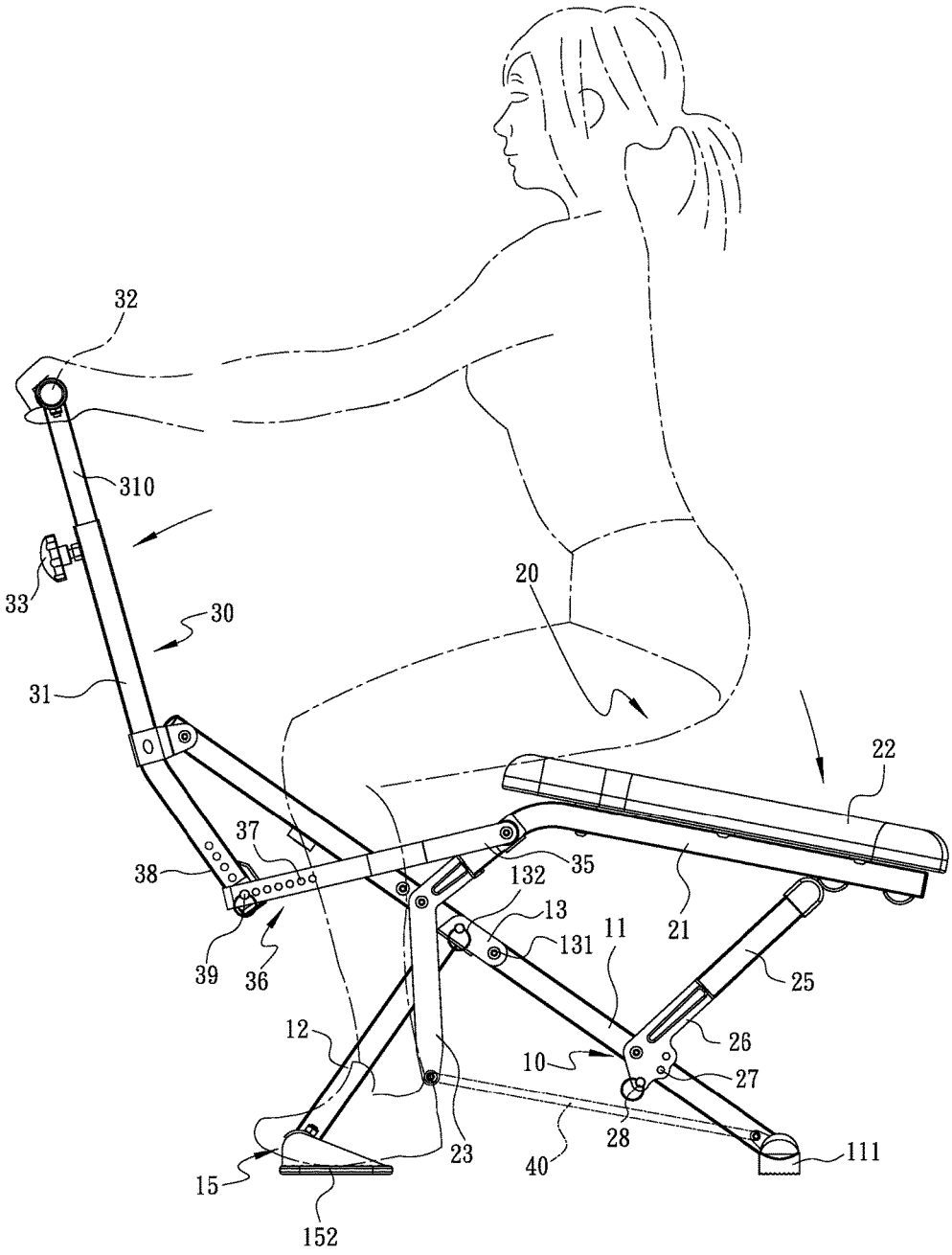
FIG. 11 is a right side view of the user and the squat rack in another position than shown in FIG. 10.

Referring to FIGS. 9 through 11, there is a squat rack according to a second embodiment of the present invention. The second embodiment is like the first embodiment except for including a telescopic element 23 between the point of connection of the seat tube 21 of the lifting unit 20 to the upper tube 11 and the crossbar 111. There is at least one elastic element 40 between the extensive element 23 and the frame 10 so that the seat tube 21 of the lifting unit 20 tends to be raised as shown in FIG. 10. The elastic element 40 can be a spring, an elastic strip, or a hydraulic or pneumatic cylinder.

Referring to FIG. 10, in use the user sets his or her feet on the treads 151 and 152 of the tread unit 15 and holds the handle 32 of the pulling unit 30 with hands. The elastic element 40 pulls the extensive element 23 backwards. The extensive element 23 lifts the seat tube 21 of the lifting unit 20 to the user's hips. The seat tube 21 of the lifting unit 20 is connected to the lever 31 of the pulling unit 30 via the connector 35. Hence, the lever 31 of the pulling unit 30 moves towards the chest of the user to keep the user stand up because.

Then, referring to FIG. 11, to squat, the user holds the handle 32 of the pulling unit 30 by the hands. Since the connector 35 is arranged between the lever 31 and the seat tube 21, the lifting unit 20 supports the user by the hips. The extensive element 23 of the seat tube 21 extends and hence loads the elastic element. The elastic element 40 pulls back and moves the seat tube 21 of the lifting unit 20 to the user's hips when the user stands up again. Hence, the seat 22 of the seat tube 21 supports the user by the hips.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A squat rack comprising:

a frame;

a tread unit comprising two treads connected to and located on two sides of the frame for supporting a user's feet so that the frame is firmly kept on the ground by the user;

a lifting unit comprising a seat tube pivotally connected to the frame, wherein the seat tube is substantially located behind the user in operation;

a pulling unit comprising a lever with a middle portion pivotally connected to a front end of the frame; and a connector for pivotally connecting the lever to the seat tube so that the user can pull the lever to cause the seat tube to support the user's hips via the connector;

wherein the treads are located between a point of connection of the seat tube to the frame and a point of connection of the lever to the frame to increase stability of the frame to facilitate the user to stand still.

2. The squat rack according to claim 1, wherein the frame comprises an upper tube and a lower tube pivotally connected to the upper tube.

3. The squat rack according to claim 2, wherein each of the upper and lower tubes comprises a crossbar connected to a lower end thereof.

4. The squat rack according to claim 3, wherein the treads are connected to two ends of the crossbar of the lower tube.

5. The squat rack according to claim 2, wherein the lifting unit comprises, a seat supported on the seat tube, wherein the seat tube is pivotally connected to the upper tube.

6. The squat rack according to claim 2, wherein the pulling unit comprises a handle connected to an upper end of the lever, wherein the middle portion of the lever is pivotally connected to a front end of the upper tube.

7. The squat rack according to claim 1, wherein the connector comprises an end pivotally connected to a lower end of the lever and another end pivotally connected to a middle portion of the seat tube.

8. The squat rack according to claim 2, wherein the frame further comprises a pivotal joint for pivotally connecting the lower tube to the upper tube, wherein the pivotal joint comprises an axle inserted in the upper tube and a pin selectively inserted in the upper tube.

9. The squat rack according to claim 2, wherein the lifting unit comprises a strut for supporting the seat tube.

10. The squat rack according to claim 9, wherein the lifting unit further comprises a joint for pivotally connecting the strut to the upper tube.

11. The squat rack according to claim 10, wherein the pivotal joint comprises includes apertures arranged about a pivotal axis and a pin inserted in a selected one of the apertures.

12. The squat rack according to claim 6, wherein the pulling unit comprises:

an extensive element comprising an end connected to the handle, another end telescopically connected to the lever, and apertures between the ends; and a fastener inserted in the lever and a selected one of the apertures of the extensive element.

13. The squat rack according to claim 12, further comprising apertures in one of the lever and the connector and a pin inserted in the other one of the lever and the connector and a selected one of the apertures.

14. The squat rack according to claim 1, further comprising an elastic element between the seat tube and the frame to facilitate the lifting unit to rise.

* * * * *